US008828189B2

(12) United States Patent
Hallas et al.

(10) Patent No.: US 8,828,189 B2
(45) Date of Patent: Sep. 9, 2014

(54) WASHER PRESS WITH MULTIPLE NIPS AND MULTIPLE DISPLACEMENT WASH ZONES

(71) Applicant: Andritz Inc., Glens Falls, NY (US)

(72) Inventors: Greg Hallas, Suwanee, GA (US); Todd S. Grace, Alpharetta, GA (US)

(73) Assignee: Andritz Inc., Glens Falls, NY (US)

( * ) Notice: Subject to any disclaimer, the term of this patent is extended or adjusted under 35 U.S.C. 154(b) by 0 days.

(21) Appl. No.: 13/735,400

(22) Filed: Jan. 7, 2013

(65) Prior Publication Data

US 2013/0192775 A1 Aug. 1, 2013

Related U.S. Application Data

(60) Provisional application No. 61/592,219, filed on Jan. 30, 2012.

(51) Int. Cl.

| | |
|---|---|
| ***D21D 1/40*** | (2006.01) |
| ***D21C 9/02*** | (2006.01) |
| ***D21C 9/18*** | (2006.01) |

(52) U.S. Cl.

CPC .. *D21D 1/40* (2013.01); *D21C 9/02* (2013.01); *D21C 9/18* (2013.01)

USPC ..... 162/232; 162/380; 210/386; 210/402; 210/404

(58) Field of Classification Search

CPC ..... D21D 1/40; D21C 9/06; D21C 9/02; B01D 33/0064; B01D 33/067; B01D 33/644; B01D 2201/282; B01D 29/6476; B01D 33/0016; B01D 33/663

USPC ..... 162/300–301, 317, 327–329, 336, 346, 162/357, 358.1, 232, 380–381; 68/22 R, 43, 68/158, 181 R; 210/386, 392, 404, 409, 210/326, 401–402; 8/156

See application file for complete search history.

(56) References Cited

U.S. PATENT DOCUMENTS

| | | | | | |
|---|---|---|---|---|---|
| 2,765,085 | A | * | 10/1956 | Strindlund | 210/196 |
| 3,125,514 | A | * | 3/1964 | Frykhult | 210/396 |
| 3,772,144 | A | | 11/1973 | Luthi | |
| 3,878,698 | A | * | 4/1975 | Friksson et al. | 68/22 R |
| 3,980,518 | A | * | 9/1976 | Ljung et al. | 162/302 |
| 4,085,003 | A | * | 4/1978 | Luthi | 162/259 |
| 4,292,123 | A | * | 9/1981 | Lintunen et al. | 162/60 |
| 4,808,265 | A | * | 2/1989 | Luthi et al. | 162/60 |
| 4,827,741 | A | * | 5/1989 | Luthi | 68/43 |
| 4,894,121 | A | * | 1/1990 | Luthi et al. | 162/329 |
| 5,046,338 | A | | 9/1991 | Luthi | |
| 5,421,176 | A | * | 6/1995 | Ojala et al. | 68/43 |
| 5,460,019 | A | * | 10/1995 | Ojala et al. | 68/43 |
| 5,667,642 | A | | 9/1997 | Luthi | |
| 5,901,585 | A | * | 5/1999 | Hoglund | 68/43 |

(Continued)

FOREIGN PATENT DOCUMENTS

| | | | | |
|---|---|---|---|---|
| EP | 2620544 A1 | * | 7/2013 | D21D 1/40 |
| WO | 94/15016 | | 7/1994 | |

(Continued)

*Primary Examiner* — Jose Fortuna

(74) *Attorney, Agent, or Firm* — Nixon & Vanderhye P.C.

(57) ABSTRACT

A washer press apparatus for washing and dewatering a wide range of solids concentrations of pulp in liquid suspensions includes multiple distinct displacement wash zones about a drum with multiple nips.

13 Claims, 2 Drawing Sheets

(56) References Cited

U.S. PATENT DOCUMENTS

| | | | | |
|---|---|---|---|---|
| 5,902,456 | A * | 5/1999 | Sundqvist et al. | 162/358.1 |
| 6,006,554 | A * | 12/1999 | Gallagher | 68/181 R |
| 7,695,591 | B2 * | 4/2010 | Lundberg et al. | 162/52 |
| 8,337,669 | B2 * | 12/2012 | Ponten et al. | 162/301 |
| 8,448,789 | B2 * | 5/2013 | Bylander et al. | 210/386 |
| 2008/0087392 | A1 * | 4/2008 | Grace | 162/53 |
| 2010/0269997 | A1 * | 10/2010 | Bylander et al. | 162/358.3 |
| 2010/0294708 | A1 * | 11/2010 | Pont n et al. | 210/236 |
| 2011/0017646 | A1 * | 1/2011 | Bylander et al. | 210/88 |
| 2013/0192775 | A1 * | 8/2013 | Hallas et al. | 162/56 |

FOREIGN PATENT DOCUMENTS

| | | | |
|---|---|---|---|
| WO | WO 9705940 | A1 * | 2/1997 |
| WO | 2005/003448 | | 1/2005 |
| WO | 2010116026 | A1 | 10/2010 |

* cited by examiner

WASHER PRESS WITH MULTIPLE NIPS AND MULTIPLE DISPLACEMENT WASH ZONES

CROSS RELATED APPLICATION

This application claims the benefit of U.S. Provisional Patent Application Ser. No. 61/592,219 filed on Jan. 30, 2012, the entirety of which is incorporated by reference.

BACKGROUND OF THE INVENTION

1. Technical Field

The present invention relates to a method and apparatus for washing and dewatering a liquid suspension of solid biological pulp material having a wide range of solids concentrations, comprising a mechanical or pressurized distributor connected to a press washer having multiple nips and multiple washing zones.

2. Related Art

In industries engaging in the production of pulp from solid biological material, such as papermaking pulp from cellulosic fibers, it is known to wash liquid pulp suspensions in order to remove organic and inorganic impurities. Washing a liquid pulp suspension typically involves flushing the suspension with water or another liquid (washing) and then removing, or simultaneously removing, at least a part of the water in the suspension (dewatering). The dewatered liquid carries away impurities contained in the pulp suspension.

Four basic types of conventional pulp washers include: drum washers with vacuum filters; belt washers with filter belts or double wire presses; diffusers for displacement washing in a tower; and washer presses in which the pulp suspension is dewatered only to a certain solids concentration. The present invention relates to the field of washer presses.

Conventional washer presses typically comprise one or two rotatable, cylindrical drums having perforations or slots capable of receiving wash liquid. The drum or drums are arranged and mounted within a correspondingly-shaped housing. The sides of the drum housing, more commonly referred to as the vat, extend partially about the surface of the drum or drums. For example, in twin-drum configurations, the drums are positioned side-by-side within a single vat, which usually extends about 180 degrees of the circumference of each drum. Conventional washer presses also typically include a feed distributor (or feeder) located near the top of the vat for introducing the pulp suspension into the washer press at a drum inlet. The pulp suspension then moves within a trough adjacent to the drum.

Washing and/or dewatering a liquid pulp suspension in a washer press involves pressing the pulp suspension against at least one rotating cylindrical drum in order to separate some of the water and move this water out of the pulp suspension into the interior of the drum. As the pulp suspension is pressed against each drum, the water or other wash liquid is pressed through slots or perforations into the interior of the drum and a mat of pulp is formed and is typically scraped off by means of a scraper. The pulp is compressed within a trough formed between a pulp slide plate or the vat and the exterior surface of the drum. The width of the trough decreases and converges to form a narrow point, called a nip, such that the pulp suspension is compressed within the narrowing trough as it is moved by the rotation of the drum toward the nip.

Alternatively, the pulp suspension can be compressed mechanically by moving the position of the pulp slide plate to decrease the distance between the pulp slide plate and the exterior surface of the drum, or this method can be combined with other compression methods. The compression of the pulp suspension by a movable or fixed pulp slide plate (a movable pulp slide plate is described in WO2010/116026) causes a portion of water in the pulp suspension to be moved through the perforations in the drum into the interior of the drum.

In wash presses incorporating a nip and pulp slide plate, the pulp suspension is most effectively washed immediately after it has been compressed and dewatered. In general in the industry, a goal is to achieve about an 8% to 10% solids concentration level in the pulp suspension at the nip point before the suspension is washed. Although higher solids concentrations at the nip point, for example, up to 15%, would yield an overall increase in the amount of impurities removed from the pulp suspension, such concentration increases are difficult to achieve due to problems with clogging of the trough.

Attempted solutions to this problem have included the introduction of additional washing at various intervals along the trough between a first, or primary nip and a last, or final nip to increase the level of impurities removed (a single displacement wash zone). The introduction of wash water in a single displacement wash zone, however, does not yield optimal results because the wash water merely mixes with existing impurities. In addition, the introduction of wash water into a single displacement wash zone is less controlled if added to the pulp suspension after it has passed the area adjacent to the primary nip. An addition of water in this manner also leads to decreased dewatering of the suspension at the end of the cycle. Movable pulp slide plates have also been used to alleviate clogs; however, washing efficiency is still limited by the physical space within which the washing must take place as the suspension moves around the drum.

Accordingly, there is a need for an improved washing and dewatering method and apparatus, more particularly a washing and dewatering method and apparatus with improved efficiency that is capable of washing and dewatering a wide range of solids concentrations in liquid suspensions. There is also a need for an improved washing and dewatering method and apparatus that provides increased impurity removal and washing capacity. There is a further need for an improved washing and dewatering method and apparatus that provides either standard washing results using less water, or improved washing results using a standard amount of water. There is still a need for a washing and dewatering method and apparatus that will accommodate a range of solids concentrations for processing. It is to these and other needs that the present invention is directed.

BRIEF SUMMARY OF THE INVENTION

Briefly, the present invention comprises a washer press wherein a liquid suspension of a solid biological pulp material is fed to the washer press using either a mechanical distributor or a pressurized distributor to a drum that comprises multiple displacement wash zones between multiple nip points. The system allows for controlled introduction of wash water or other appropriate liquid at an effective location in the trough and at a desirable solids concentration. The system further allows for the removal of water and impurities after an initial dewatering cycle, followed by an additional compression and washing cycle under optimum pulp washing conditions. The system in accordance with the present invention yields a standard solids consistency and an increased purity level using the same amount of water while avoiding problems caused by increasing the surface area of the outer drum surface in contact with the liquid pulp suspension (or length) in the displacement wash zone. The multiple nip multiple displacement wash zone washer press in accordance with the present invention allows for the processing of a wide range of solids concentrations. Therefore, the present invention provides in both single and a twin-drum washer presses increased washing efficiency with the versatility of operating in either a medium or low consistency process application.

Increased washing efficiency is achieved by providing a trough for pulp distribution using multiple pulp slide plates to direct the liquid pulp suspension into the trough and along a drum surface. The pulp suspension is fed into the trough by means of a pulp distributor, such as a mechanical distributor for medium consistency suspensions or pressure distributor for low consistency suspensions, to evenly disperse the pulp along the full length of the trough to form an even pulp mat.

The mechanical pulp distributor consists of a tapered, center feed reverse flighted screw that evenly distributes the pulp along the length of the drum. The pressure pulp distributor comprises a pressure headbox with changeable orifices to create an even pulp formation. Both distributors can be bolted to an existing washer press vat. The distributor has a longitudinal seal and end seals to separate the product from the atmosphere. In an alternative embodiment, the distributor housing has a first pulp slide plate, which can be static or adjustable or movable thereby creating an upper nip point. A second pulp slide plate, which can also be static or adjustable thereby creating a lower nip point, may be incorporated to allow for a second displacement wash zone along the drum. In an exemplary embodiment, the location at which the pulp suspension enters and contacts the surface of the drum is adjusted such that the surface area of the outer drum surface in contact with the liquid pulp suspension is increased by 15% to 25%, and preferably 15% to 20%, compared with conventional designs. Therefore, the method and use of the apparatus, in an exemplary embodiment, could result in the pulp suspension contacting 65% to 75% of the total surface area of the drum, where only about 50% of the surface area of the drum is contacted in conventional applications.

As the pulp suspension enters and contacts the outer drum surface, a movable or static pulp slide plate directs the pulp suspension along the outer drum surface where dewatering begins. Dewatering continues as the liquid pulp suspension is moved between the walls of the trough by the rotation of the drum to a first point of constriction in the trough, called the primary nip. The primary nip is the point in the trough downstream from the drum inlet having the narrowest width. Although the width of the trough at the primary nip is narrow, the width of the trough immediately after and downstream from the narrowed nip point increases at the first release point, where the first stream of wash water or other liquid is added. This introduction of wash water or other liquid in a first displacement wash zone allows the solids within the pulp suspension to be washed and continually dewatered as they pass the length of the first displacement wash zone, which is defined by the outer drum surface and a second pulp slide plate as the sides, and the first release point and a secondary nip as the ends. In one embodiment, the first displacement wash zone located between the primary nip and the secondary nip contacts about 20 to 25% of the surface area of the drum. In another embodiment, the width of the primary nip can be adjusted, for example, by changing the position of an adjustable pulp slide plate.

In an exemplary embodiment, the width of the trough immediately after and downstream from the secondary nip increases. This area is called the second release point, which is the beginning of a second displacement wash zone in the trough having the smallest opening dimension. Although the width of the trough at the secondary nip is the narrowest within the first displacement wash zone, the width of the trough beginning at the second release point is increased and forms a third segment (the second displacement wash zone). The second displacement wash zone is defined by the vat and the drum outer surface on the sides, the second release point on one end, and a final nip at the other end.

Wash water or other liquid is again added at the second release point downstream from the secondary nip, and the pulp suspension is continually washed and dewatered as the pulp is pulled by the drum through the second displacement wash zone of the trough, terminating at the area of the trough in the second displacement wash zone having the narrowest width: the final nip. The second displacement wash zone allows for the displacement of the first displacement wash water (or other liquid) and the impurities contained therein, and it allows for the introduction of second displacement wash water (or other liquid), thus creating a more effective wash and contaminant removal. In accordance with an embodiment of the method described herein, the final solids concentration of the resultant fiber mat reaching the final nip is approximately 30% to 35%, and in another embodiment, is 30% to 33%. In another embodiment, the width of the trough at the secondary and final nips can be adjusted, for example, by changing the position of an adjustable pulp slide plate. As an illustrative example, the width of the secondary nip can be the greatest, followed by the width of the primary nip, and then the width of the final nip. The width of the nips can be adjusted to optimize solids concentration and to prevent blockage.

These features, and other features and advantages disclosed herein will become more apparent to those of ordinary skill in the art when the following detailed description of the preferred embodiments is read in conjunction with the appended figures.

DETAILED DESCRIPTION OF THE PREFERRED EMBODIMENTS

The foregoing detailed description of the preferred embodiments is presented only for illustrative and descriptive purposes and is not intended to be exhaustive or to limit the scope and spirit of the invention. The embodiments were selected and described to best explain the principles of the invention and its practical application. One of ordinary skill in the art will recognize that many variations can be made to the invention disclosed in this specification without departing from the scope and spirit of the invention.

Figure 2:
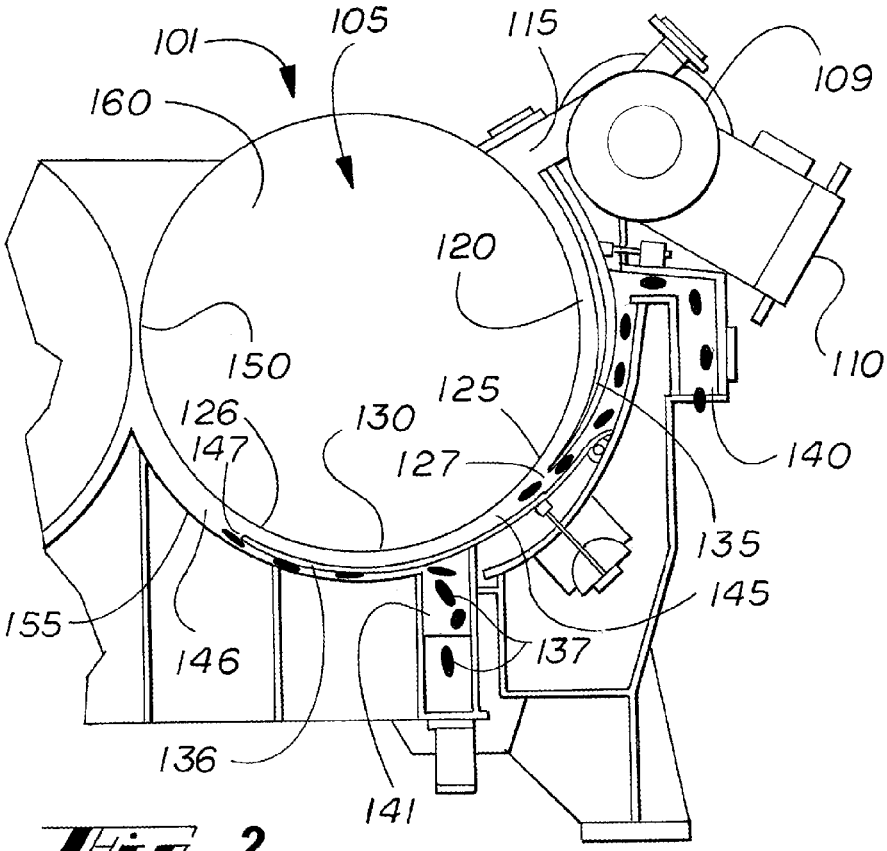
FIG. 2 is a partial sectional end view of a washer press in accordance with the present invention incorporating a primary, secondary, and final nip into a mechanical pulp distributing system.
Figure 3:
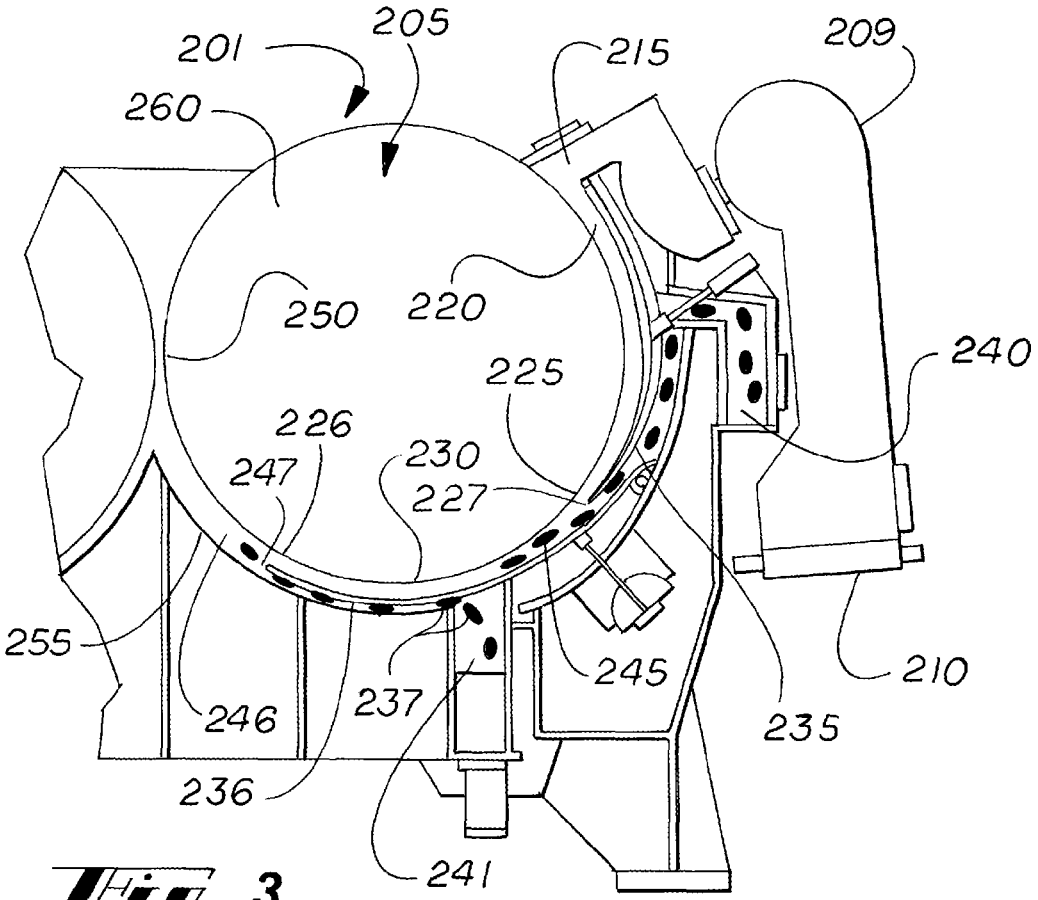
FIG. 3 is a partial sectional end view of a washer press in accordance with the present invention incorporating a primary, secondary, and final nip into a pressure pulp distributing system.

Illustrative embodiments of a washer press with multiple nips in accordance with the disclosure are shown in FIGS. 2-3. The present invention is a multiple nip multiple displacement wash zone washer press suitable for use in conjunction with a pulp dewatering system, and methods for using same.

Currently, there is a need for a pulp dewatering system that provides increased efficiency and purity while accommodating pulp suspensions having a wide range of solids concentrations.

An invention has been developed for a pulp suspension washer press having at least one drum with an exterior drum surface disposed within a vat; a pulp distributor having a pulp inlet adjacent to the drum; at least one pulp slide plate adjacent to the exterior drum surface; a trough having two sides and two ends, where the trough sides comprise the exterior drum surface on one side and the pulp slide plate or the vat on the other side. The trough ends comprise a pulp inlet on one end and a nip on the other end, and there are at least two displacement wash zones within the trough, where the displacement wash zones each have a first end and a second end, and where each first and second end of the displacement wash zones comprise a nip.

Another embodiment of the invention has been developed for a pulp suspension washer press having at least one drum with an exterior drum surface disposed within a vat; a pulp distributor having a pulp inlet adjacent to the drum; multiple pulp slide plates adjacent to the exterior drum surface; a trough having two sides and two ends, where the trough sides comprise the exterior drum surface on one side and at least one pulp slide plate or the vat on the other side. The trough ends comprise a pulp inlet on one end and a nip at the other end, and at least two displacement wash zones are within the trough. The displacement wash zones each have a first end and a second end, where each first and second end of the displacement wash zones is adjacent to a nip, and the width of each nip within the trough is less than the width of the remainder of the respective trough sections comprising the displacement wash zones.

A method has also been developed for washing and dewatering a liquid pulp suspension which includes feeding a liquid pulp suspension into a pulp distributor; placing a drum inlet attached to the pulp distributor at a location along an exterior drum surface of a drum such that liquid pulp suspension fed into the pulp distributor and contacting the exterior drum surface through the drum inlet contacts 65% to 75% of the entire surface area of the exterior drum surface, whereby multiple displacement wash zones are created in the area of the exterior drum surface contacted by the liquid pulp suspension.

Additionally, another method has been developed for washing and dewatering a liquid pulp suspension which includes feeding a liquid pulp suspension into a trough between an exterior drum surface and a pulp slide plate; guiding the pulp suspension into a first zone within the trough with a first pulp slide plate; simultaneously moving and dewatering the pulp suspension through the first zone with a rotating drum; concentrating the pulp suspension at a primary nip; guiding the pulp suspension into a first displacement wash zone adjacent the primary nip; simultaneously moving, washing, and dewatering the pulp suspension through the first displacement wash zone; concentrating the pulp suspension at a secondary nip; guiding the pulp suspension into a second displacement wash zone within the trough; adding a second volume of wash liquid into the second displacement wash zone adjacent the secondary nip; simultaneously moving, washing, and dewatering the pulp suspension through the second displacement wash zone; and concentrating the pulp suspension at a final nip, to form a pulp mat.

In one embodiment of the present invention, the placement of a mechanical or pressure distributor to feed the pulp suspension into the washer press provides an advantageous result in the dewatering process. In this embodiment, the position of the pulp distributor is adjusted to allow for an increase in the angle at which the suspension is fed to the drum (the feed angle), allowing for an increased dewatering region and additional contact duration to form a quality fiber mat along the exterior surface of the drum.

Figure 1:
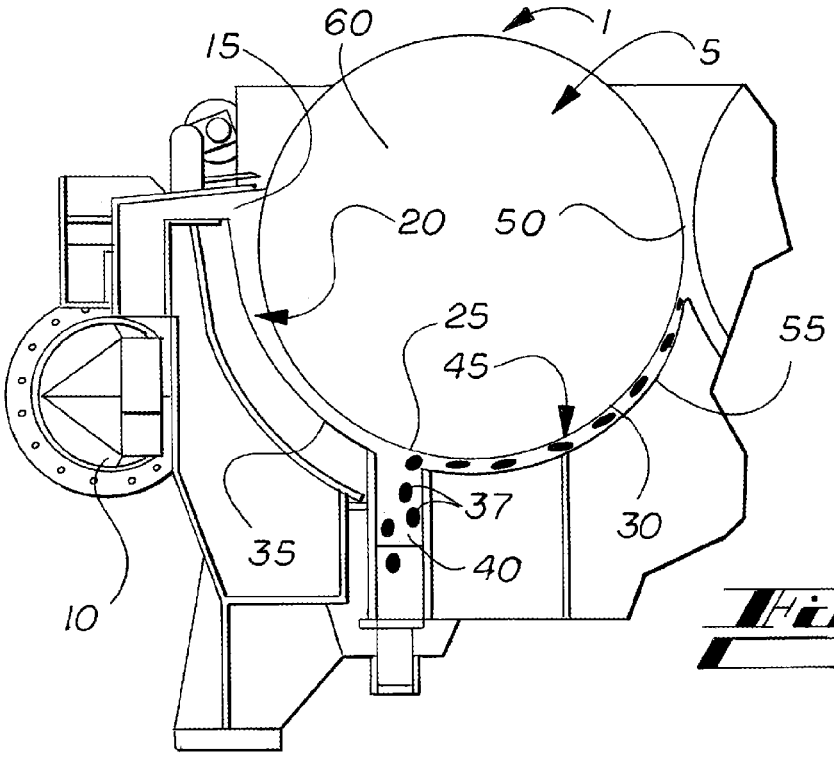
Fig. 1 (PRIOR ART)
FIG. 1 is a partial sectional end view of a conventional washer press.

Referring now to FIG. 1, which illustrates a conventional washer press 1 comprising a drum 5 and other critical features. The conventional washer press 1 is of a twin drum configuration (the left drum is partially shown), but a single drum washer press and other configurations are known in the art. A pulp suspension enters the conventional washer press 1 at a pulp inlet 10, and is transported to a drum inlet 15. A trough 20 is located between the drum inlet 15 and a primary nip 25 formed on one side by an outer drum surface 30, and on the other side by a pulp slide plate 35. The pulp suspension is dewatered as it moves within the trough 20 toward the primary nip 25.

At the primary nip 25, wash water 37 or other liquid is added from a water header 40 into the pulp suspension in a displacement wash zone 45. This wash water 37 allows the solids in the suspension to be washed as the suspension is continuously dewatered. As the pulp suspension moves through the displacement wash zone 45 to a final nip 50, the suspension is both washed and dewatered because the distance between the outer drum surface 30 on one side, and a vat 55 on the other side, is reduced, which compresses the suspension and separates the liquid from the pulp suspension. The narrowest point of the displacement wash zone 45 within the trough 20 is the final nip 50.

Washing and dewatering simultaneously occurs as the pulp suspension moves through the trough 20 and away from the drum inlet 15, by the rotation of the drum 5, until the final nip 50 is reached. At this point, the liquid pulp suspension has been concentrated and a pulp mat has formed on the outer drum surface 30. The liquid separated from the compressed pulp suspension is passed through the outer drum surface 30 into the drum interior 60, where the liquid then exits the washer press 1.

Referring now to FIG. 2, a washer press 101 in accordance with an embodiment of the present invention in conjunction with a mechanical pulp distributor 109 can be used to feed a medium-consistency pulp suspension having, for example, a consistency of about 2.5% to about 11% solids, or about 2.5% up to about 15% solids, into the washer press 101. The washer press 101 comprises a drum 105 having a drum inlet 115 positioned adjacent the drum 105. The pulp suspension enters the washer press 101 at a pulp inlet 110, is fed through the mechanical pulp distributor 109, and then enters a trough 120 through a drum inlet 115. In an exemplary embodiment, the position of the drum inlet 115 and the mechanical pulp distributor 109 are adjusted to allow for an increase in the angle at which the suspension is fed into the drum 105 such that the distance between the drum inlet 115 and a final nip 150, as measured along the circumference of an exterior drum surface 130, has increased between 15% and 30% as compared to the distance between these points on a conventional wash press 1 (as shown in FIG. 1). Further, the drum inlet 115 is positioned such that the total surface area of the exterior drum surface 130 contacted by the pulp suspension is increased between 15% and 30% as compared with a conventional wash press 1 (as shown in FIG. 1).

The mechanical pulp distributor 109 comprises a tapered, center feed reverse flighted screw that evenly distributes the pulp along the surface of the drum 105. The mechanical pulp distributor 109 can be bolted to an existing washer press vat or other suitable location. The mechanical pulp distributor 109 has a longitudinal seal and end seals to separate the product from the atmosphere. In an alternative embodiment, the distributor housing has an adjustable plate as known as a first pulp slide plate 135. A second pulp slide plate 136 may be incorporated to allow for additional washing zones along the trough 120. In other alternative embodiments, the first and second pulp slide plates 135 and 136 can be fixed or adjustable.

The liquid pulp suspension flows through the trough 120 across the exterior drum surface 130, and is guided by the fixed or movable first pulp slide plate 135 where dewatering begins. The trough 120 has been formed by the first pulp slide plate 135 and a second pulp slide plate 136 on one side, and the exterior drum surface 130 on the other side, and the length of the trough 120 extends from the drum inlet 115 to the final nip 150. Dewatering continues as the liquid pulp suspension is pulled through the trough 120 by the rotation of the drum 105 through a first zone ending at the narrowest point in the trough 120 downstream from the drum inlet 115, the primary nip 125. As the pulp suspension moves from the drum inlet 115 to the primary nip 125, the distance between the exterior drum surface 130 and the first pulp slide plate 135 is reduced in order to dewater the suspension by separating a portion of water from the pulp suspension. Although the primary nip 125 is the point in the first zone of the trough 120 with the smallest width, the width of the trough 120 immediately after and downstream from the primary nip 125 widens again to a second section in the trough 120 having a width larger than that of the primary nip 125, called the first release point 127. The pulp suspension is dewatered when the water squeezed and separated from the suspension is passed through the exterior drum surface 130 into the drum interior 160, where the water then exits the washer press 101.

At the first release point 127, a first stream or volume of wash water 137 or other liquid is added to the washer press 101 from a first water header 140. This wash water 137 or other liquid allows the solids in the suspension to be washed while continuously being dewatered. The first stream of wash water 137 can be fresh, or can be recycled from elsewhere in the plant. As the solids mixed with the wash water 137 move along the exterior drum surface 130 toward the final nip 150, a second pulp slide plate 136 is positioned in a first displacement wash zone 145 located between the first release point and a secondary nip 126. In another exemplary embodiment, the second pulp slide plate 136 is fixed rather than movable.

In this embodiment, the location of the first displacement wash zone 145 is defined by the exterior drum surface 130 and a second pulp slide plate 136 as the sides, and the first release point and the secondary nip 126 at each end. In another exemplary embodiment, the first displacement wash zone 145 located between the primary nip 125 and the secondary nip 126 contacts about 20% to 30% of the surface area of the drum 105. The width of the trough 120 at the primary or secondary nips 125 or 126 can be adjusted by changing the position of adjustable first or second pulp slide plates 135 or 136.

The solids in the pulp suspension are washed and the suspension is dewatered simultaneously as the suspension moves through the first displacement wash zone 145 between the primary nip 125 and the secondary nip 126. A second stream or volume of wash water 137 or other liquid is introduced to the liquid pulp suspension through a second water header 141 at or about a point in the trough 120 immediately after and downstream from the secondary nip 126, called the second release point 147.

At the second release point 147, the width of the trough 120 increases again to begin a third section in the trough 120 having a width larger than that of the secondary nip 126. The solid material is then subjected to a second washing cycle, with continuous dewatering, in a second displacement wash zone 146. The second displacement wash zone 146 is located between the second release point 147 and the final nip 150 at the ends, and the exterior drum surface 130 and a vat 155 at the sides. The second wash water 137 used in the second displacement wash zone 146 can be fresh, or recycled from elsewhere in the plant. At the final nip 150, the liquid pulp suspension has been concentrated to a solids consistency of approximately 30% to 35%, and a pulp mat has formed on the exterior drum surface 130. The liquid separated from the compressed pulp suspension is passed through the exterior drum surface 130 into the drum interior 160, where the liquid then exits the washer press 101.

The second displacement wash zone 146 allows for the displacement of the first wash water 137 and the impurities contained therein and the introduction of second wash water 137, thus creating a more effective wash and contaminant removal. In accordance with an alternative embodiment of the method of the present invention, the final solids concentration of the resultant fiber mat reaching the final nip 150 is approximately 30% to 33%. In another embodiment of an apparatus in accordance with the present invention, the width of the secondary nip 126 can be the greatest as between the widths of each of the other multiple nips, followed by the primary nip 125, with the final nip 150 having the smallest width. The width of the nips can be adjusted to optimize solids concentration and to prevent plugging or blockage. Although the washer press 101 in some exemplary embodiments is of a side-by-side twin-drum washer press configuration, or a bottom-to-top twin drum or a single drum configuration, other configurations known in the art are suitable for use in conjunction with the present invention. The method and apparatus in accordance with the present invention produce the same or better results as conventional methods and apparatuses, while increasing the efficiency of the washer press and yielding a pulp mat that can be as great as 18% more purified. Additionally, this apparatus can result in increased production capacity by as much as 30%.

Figure 4:
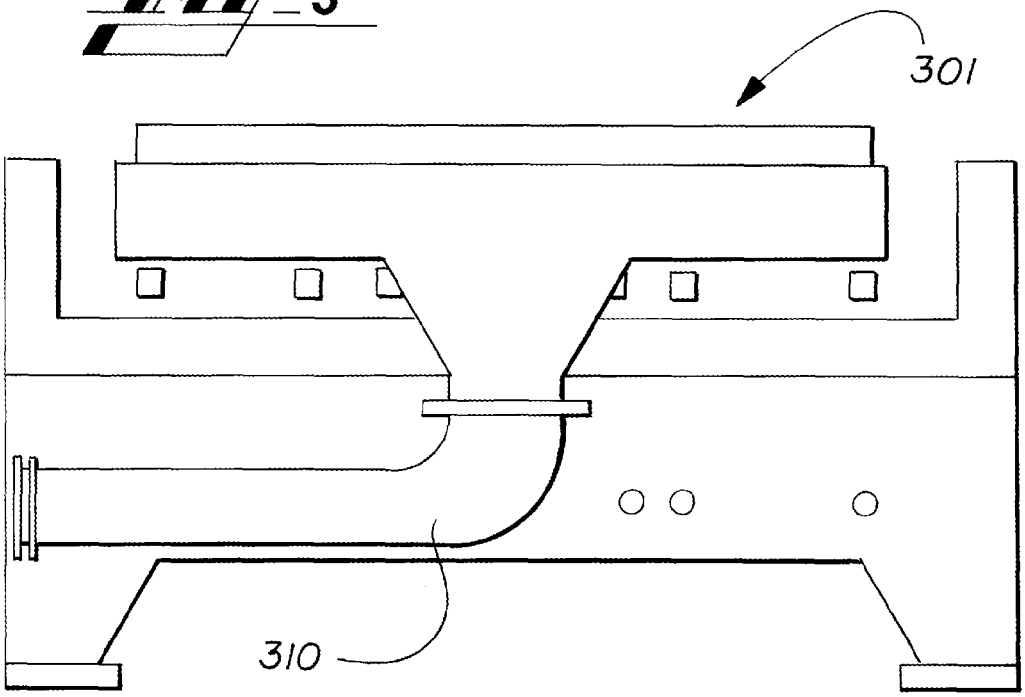
FIG. 4 is a side perspective view of a pulp inlet for a pressure pulp distributing system.

Turning now to FIG. 3, a washer press 201 in accordance with another embodiment of the disclosure in conjunction with a pressure pulp distributor 209 and 301 (FIG. 4) can be used to feed a low-consistency pulp suspension having, for example, a consistency of about 2.5% to about 5% solids, into the washer press 201. Washer press 201 comprises a drum 205 having a drum inlet 215. The pulp suspension enters the washer press 201 at a pulp inlet 210, is fed through the pressure pulp distributor 209, and then enters the trough 220 through the drum inlet 215. Drum inlet 215 is positioned along an exterior drum surface 230 such that the distance between the drum inlet 215 and a final nip 250, as measured along the circumference of the exterior drum surface 230, has increased between 15% and 30% as compared to the distance between these points on a conventional wash press 1 (FIG. 1).

The pressure pulp distributor 209 and 301 (FIG. 4) is comprised of a pressure headbox with changeable orifices to create an even pulp suspension formation. The pressure pulp distributor 209 and 301 can be bolted to an existing washer press vat or other suitable structure. The pressure pulp distributor 209 and 301 has a longitudinal seal and end seals to separate the product from the atmosphere. The pressure pulp distributor 209 and 301 have the pulp inlet 210 and 310 (FIG. 4) attached to allow pulp suspension to be fed to the washer press 201.

The liquid pulp suspension flows through the trough 220 across the exterior drum surface 230. Trough 220 has been formed by a movable or fixed first pulp slide plate 235 and a second pulp slide plate 236 on one side, and the exterior drum surface 230 on the other side, and the length of the trough 220 extends from the drum inlet 215 to the final nip 250. As the pulp suspension moves from the drum inlet 215 to a primary nip 225, the distance between the exterior drum surface 230 and the first pulp slide plate 235 is reduced in order to dewater the suspension by separating a portion of the water from the pulp. The pulp suspension is dewatered when the water squeezed and separated from the suspension is passed through perforations in the exterior drum surface 230 into a drum interior 260, where the water then exits the washer press 201.

Immediately after and downstream from the primary nip 225, wash water 237 or other liquid is added to the washer press 201 from a first water header 240 at a first release point 227. This wash water 237 allows the solids in the suspension to be washed and dewatered. As the solids and wash water 237 move along the exterior drum surface 230 toward the final nip 250, a movable or fixed second pulp slide plate 236 is positioned in a first displacement wash zone 245 located between the first release point 227 and a secondary nip 226. In another exemplary embodiment, the second pulp slide plate 236 comprises a second movable pulp slide plate. In yet another exemplary embodiment, the second pulp slide plate 236 comprises a fixed pulp slide plate while the first pulp slide plate 235 comprises a fixed pulp slide plate.

The solids in the suspension are washed and the suspension is simultaneously dewatered as the suspension moves through the first displacement wash zone 245 between the first release point 227 and the secondary nip 226. A second volume of wash water 237 is introduced to the liquid pulp suspension through a second water header 241 into the trough 220 immediately after and downstream from the secondary nip 226, called the second release point 247. The solid material is subjected to a second washing cycle and is simultaneously dewatered in a second displacement wash zone 246, defined by the second release point 247 and the final nip 250 at the ends, and the exterior drum surface 230 and the vat 255 at the sides. At the final nip 250, the suspension has been concentrated to a solids consistency of approximately 30% to 35%, or approximately 30% to 33%, and a pulp mat has formed on the exterior drum surface 230. A doctor blade (not shown) is used to remove the pulp mat from along the exterior drum surface 230.

It is to be understood that the present invention is by no means limited to the particular constructions and method steps herein disclosed or shown in the drawings, but also comprises any modifications or equivalents within the scope of the claims known in the art. It will be appreciated by those skilled in the art that the devices and methods herein disclosed will find utility with respect to multiple pulp processing applications and the like.

What is claimed is:

1. A pulp suspension washer press comprising:

a. at least one drum having an exterior drum surface disposed within a vat;

b. a pulp distributor having a drum inlet adjacent to the drum;

c. at least one pulp slide plate adjacent to the exterior drum surface;

d. a trough having two sides and two ends, wherein said trough sides comprise the exterior drum surface on one side and the pulp slide plate or the vat as the other side, and said trough ends comprise the drum inlet on one end and a nip at the other end;

e. a first displacement wash zone within the trough; wherein said first displacement wash zone has a first end and a second end, and wherein said first and said second end of said first displacement wash zone comprises a nip; and f. at least one second displacement wash zone within the trough downstream from said first displacement wash zone; wherein said at least one second displacement wash zone has a first end and a second end, and wherein said first and said second end of said at least one second displacement wash zone comprises a nip.

2. A pulp suspension washer press as in claim 1 wherein multiple pulp slide plates are adjacent to the exterior drum surface.

3. A pulp suspension washer press as claimed in claim 1, wherein the first displacement wash zone comprises a primary nip and a secondary nip, and the at least one second displacement wash zone comprises the secondary nip and a final nip.

4. A pulp suspension washer press comprising:

a. at least one drum having an exterior drum surface disposed within a vat;

b. a pulp distributor having a drum inlet adjacent to the drum;

c. multiple pulp slide plates adjacent to the exterior drum surface;

d. a trough having two sides and two ends, wherein said trough sides comprise the exterior drum surface on one side and the at least one pulp slide plate or the vat on the other side, and said trough ends comprise the drum inlet on one end and a nip at the other end; and e. a first displacement wash zone and at least one second displacement wash zone within the trough, and wherein the first displacement wash zone and the at least one second displacement wash zone each have a first end and a second end, and wherein each first and second end of said first displacement wash zone and said at least one second displacement wash zone is adjacent to a nip, and wherein a width of each nip within the trough is less than a width of the remainder of the respective trough sections comprising the first displacement wash zone and at least one second displacement wash zone.

5. A pulp suspension washer press as claimed in claim 4, wherein the first displacement wash zone comprises a primary nip and a secondary nip, and the at least one second displacement wash zone comprises the secondary nip and a final nip.

6. A pulp suspension washer press as claimed in claim 4, wherein at least one pulp slide plate is static.

7. A pulp suspension washer press as claimed in claim 4, wherein at least one pulp slide plate is movable and/or adjustable.

8. A pulp suspension washer press as claimed in claim 4 wherein the first displacement wash zone contacts about 20% to 30% of the surface area of the drum.

9. A pulp suspension washer press as claimed in claim 4, wherein 65% to 75% of the total surface area of the drum is contacted by the pulp suspension.

10. A pulp suspension washer press as claimed in claim 4, wherein the pulp distributor comprises a tapered center feed reverse flighted screw configured to distribute pulp evenly over the length of the drum.

11. A pulp suspension washer press as claimed in claim 4, wherein the pulp distributor has a distributor housing connected to a first end of the at least one side plate and wherein the distributor housing is configured to move such that a second end of the at least one slide plate opposite the first end is capable of creating a primary nip point.

12. A pulp suspension washer press as claimed in claim 4, wherein the pulp distributor comprises a pressure headbox.

13. A pulp suspension washer press comprising:

a. at least one drum having an exterior drum surface disposed within a vat;

b. a pulp distributor having a drum inlet adjacent to the drum;

c. at least one pulp slide plate adjacent to the exterior drum surface;

d. a trough having two sides and two ends, wherein said trough sides comprise the exterior drum surface on one side and the pulp slide plate or the vat as the other side, and said trough ends comprise the drum inlet on one end and a nip at the other end, wherein the least one pulp slide plate is within the trough and the at least one side plate has a first end and a second end, wherein the first end is adjacent to the drum inlet and the second end continuously converges toward the drum to form a nip such that a pulp suspension continuously converges towards the drum;

e. a first displacement wash zone within the trough; wherein said first displacement wash zone has a first end and a second end, and wherein said first and said second end of said first displacement wash zone comprises a nip; and f. at least one second displacement wash zone within the trough downstream from said first displacement wash zone; wherein said at least one second displacement wash zone has a first end and a second end, and wherein said first and said second end of said at least one second displacement wash zone comprises a nip.

* * * * *